US011590635B2

(12) United States Patent
Hsieh

(10) Patent No.: US 11,590,635 B2
(45) Date of Patent: Feb. 28, 2023

(54) HAND TOOL WITH OPERATING HEAD

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 0 days.

(21) Appl. No.: 16/990,737

(22) Filed: Aug. 11, 2020

(65) Prior Publication Data

US 2021/0046625 A1 Feb. 18, 2021

(30) Foreign Application Priority Data

Aug. 14, 2019 (TW) ..... 108129011

(51) Int. Cl.
*B25B 23/00* (2006.01)

(52) U.S. Cl.
CPC ..... *B25B 23/0028* (2013.01); *B25B 23/0035* (2013.01)

(58) Field of Classification Search
CPC ..... B25B 23/0028; B25B 23/0035
See application file for complete search history.

(56) References Cited

U.S. PATENT DOCUMENTS 776,761 A * 12/1904 Sampson ..... B25B 13/481 81/177.8
1,498,713 A * 6/1924 York ..... B25G 1/005 81/177.75
1,521,464 A * 12/1924 Miller ..... B25B 13/28 81/99
5,568,757 A * 10/1996 Lewis ..... B25B 23/0021 81/177.85
7,461,575 B2 * 12/2008 Tribby ..... B25B 13/481 81/124.3
2010/0154604 A1 * 6/2010 Su ..... B25G 1/066 81/450

* cited by examiner

*Primary Examiner* — Hadi Shakeri
(74) *Attorney, Agent, or Firm* — Guice Patents PLLC

(57) ABSTRACT

The invention is a hand tool with an operating head, which comprises: a main body having two parallel ears spaced apart at a front end; and a working head having a body; a column connected to one side of the body; another side of the body is provided with a pivotal block and two flaps to pivotally connect the two ears of the main body between the pivotal block and the two flaps respectively. The two flaps are capable of assisting in supporting outer sides of the two ears to relatively strengthen a structure of the ear, thereby enhancing a torsion exerted by the column on a workpiece, and enhancing durability and strength of the column.

8 Claims, 6 Drawing Sheets

HAND TOOL WITH OPERATING HEAD

BACKGROUND OF THE INVENTION

Field of Invention

The invention relates to a hand tool, and more particularly to a hand tool with an operating head.

Related Art

Please refer to FIG. 1 for a conventional hand tool 10 including: a main rod 11 and a working head 12, a front end of the main rod 11 is provided with two ears 111; one end of the working head 12 has a pivotal portion 121 pivotally disposed between the two ears 111, and another end of the working head 12 is provided with a column 122. By pivotally disposing the pivotal portion 121 of the working head 12 on the ears 111, a working direction can be changed by rotating the working head 12 relative to the main rod 11, and a workpiece is driven by the column 122 to tighten or loosen the workpiece.

However, in the process of applying a force, an acting force of the main rod 11 of the conventional hand tool 10 easily causes the two ears 111 to be twisted and deformed when the pivotal portion 121 is driven. Because there is no support at outer sides the two ears 111, when a force is applied to rotate the pivotal portion 121, the two ears 111 are easily deformed to a great degree due to excessive force being applied, and the two ears 111 are damaged by shear stress and deformation effect. Therefore, the main rod 11 is often damaged or broken at the two ears 111 and becomes unusable.

SUMMARY OF THE INVENTION

A main object of the invention is to provide a hand tool capable of strengthening a structural support of an ear and enhancing a torsion.

In order to achieve the above object, the invention provides a hand tool with an operating head, which includes:

a main body having two ears disposed in parallel and spaced apart at a front end; and a working head having a body; a column connected to one side of the body; and another side of the body is formed with two parallel flaps and a pivotal block, the pivotal block is disposed between the two flaps, a gap is provided between the pivotal block and each of the two flaps, and the two ears of the main body are pivotally disposed in the gaps between the two flaps and the pivotal block respectively.

Preferably, the two ears of the main body are respectively provided with coaxial connecting holes therethrough; the pivotal block is provided with a through hole therethrough, the two flaps are respectively provided with a perforation therethrough, the through hole and the perforations are arranged coaxially; and a pin is pivotally disposed between the connecting holes, the through hole and the perforations.

Preferably, the two ears of the main body are respectively provided with coaxial connecting holes therethrough; the pivotal block is provided with a through hole therethrough, and a pin is pivotally disposed between the connecting holes and the through hole.

Preferably, an outer diameter of the pivotal block is smaller than an outer diameter of the body, and reinforcement blocks are provided at junctions of the pivotal block and the body.

In the hand tool with the operating head provided by the invention, the pivotal block and the two flaps disposing on the working head are capable of providing a strengthening effect to the two ears of the main body, enhancing a force-bearing strength of the two ears, and preventing the two ears from deforming excessively during operation, thereby enhancing a torsion applied by the column to a workpiece, and the column is not easily damaged to improve the strength and service life.

BRIEF DESCRIPTION OF THE DRAWINGS

In order to enable the examiner to further understand the object, features and achieved efficacies of the invention, two preferred embodiments are listed below, which will be described in detail hereinafter in conjunction with the drawings, wherein.

DETAILED DESCRIPTION OF THE INVENTION

Figure 1:
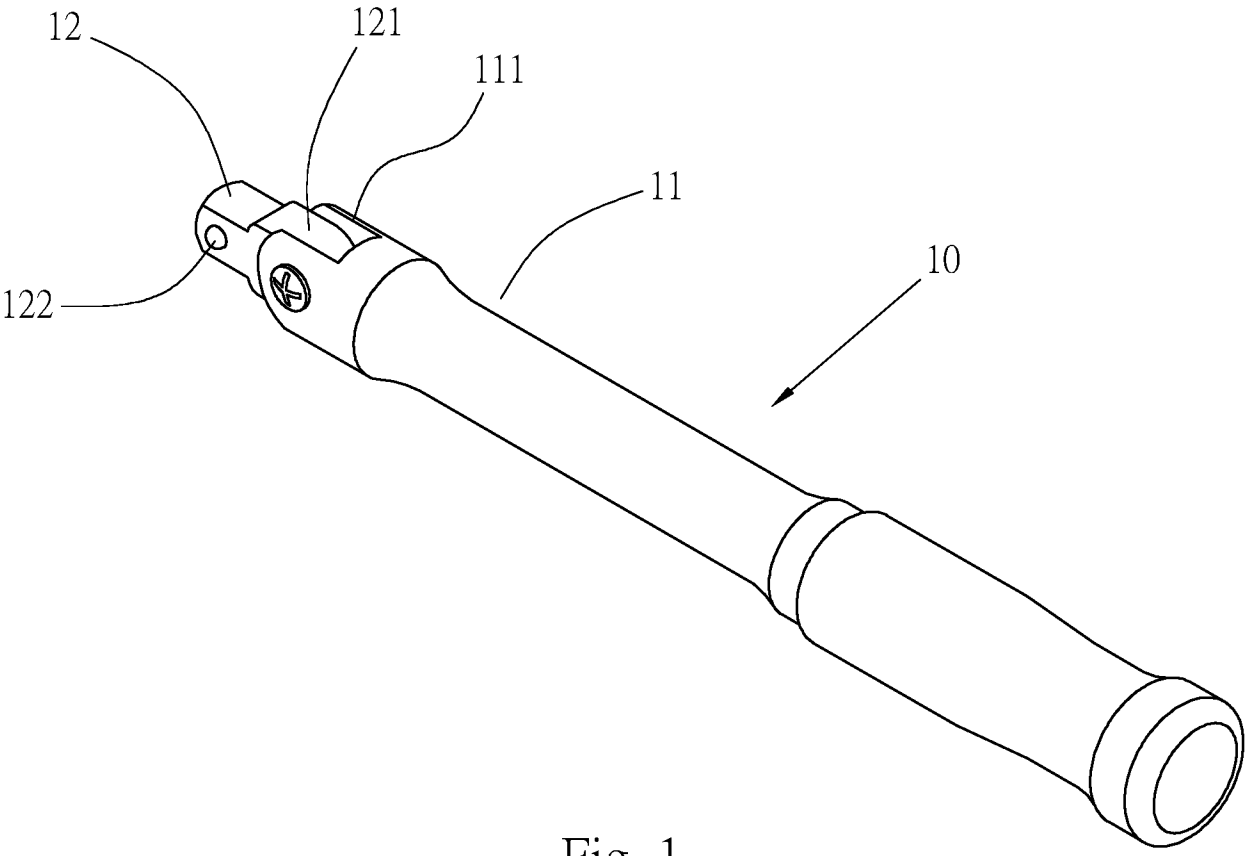
Fig. 1 PRIOR ART
FIG. 1 is a perspective view of a conventional hand tool.
Figure 2:
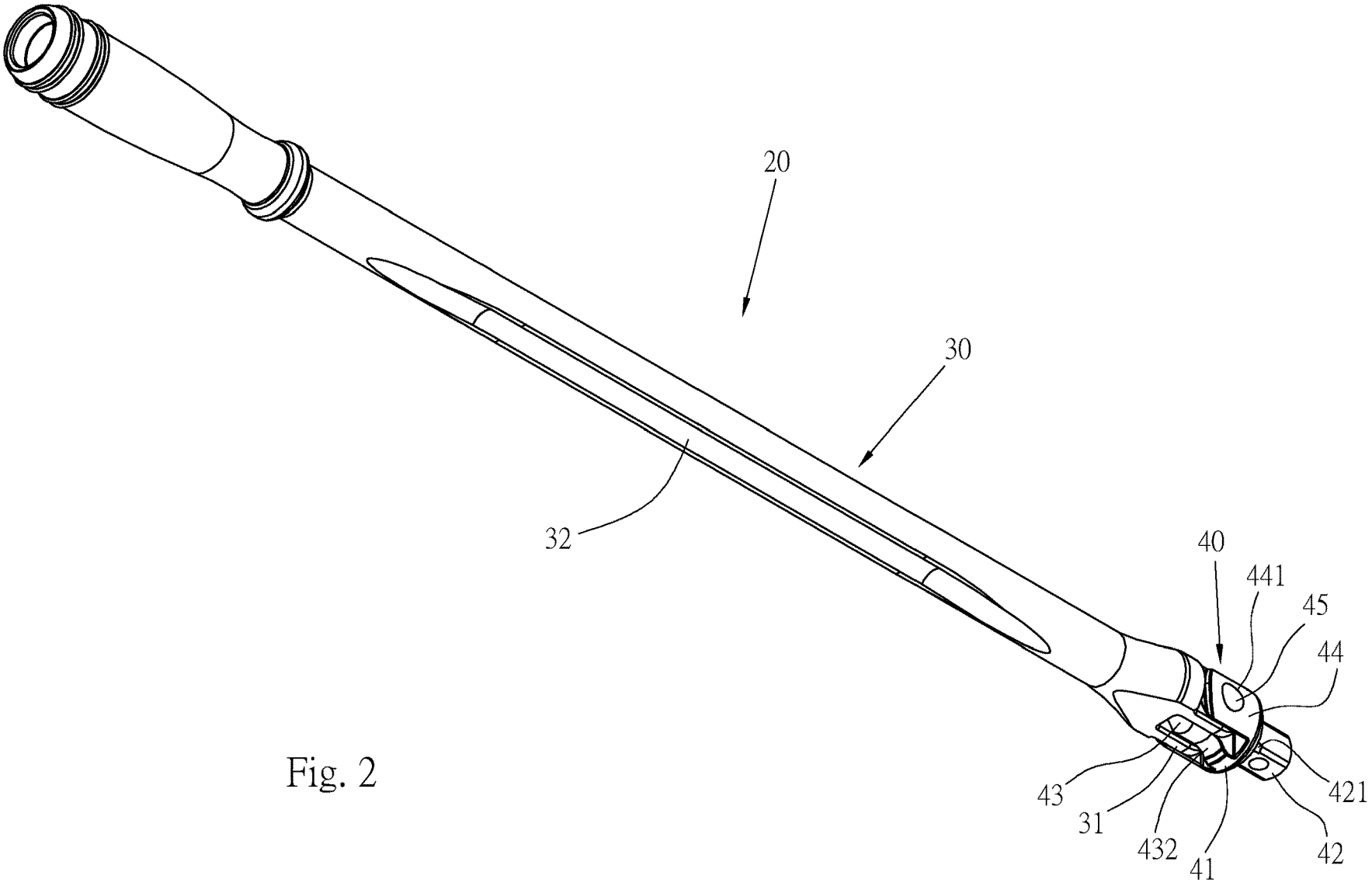
FIG. 2 is a perspective view of a hand tool according to one preferred embodiment of the invention.
Figure 3:
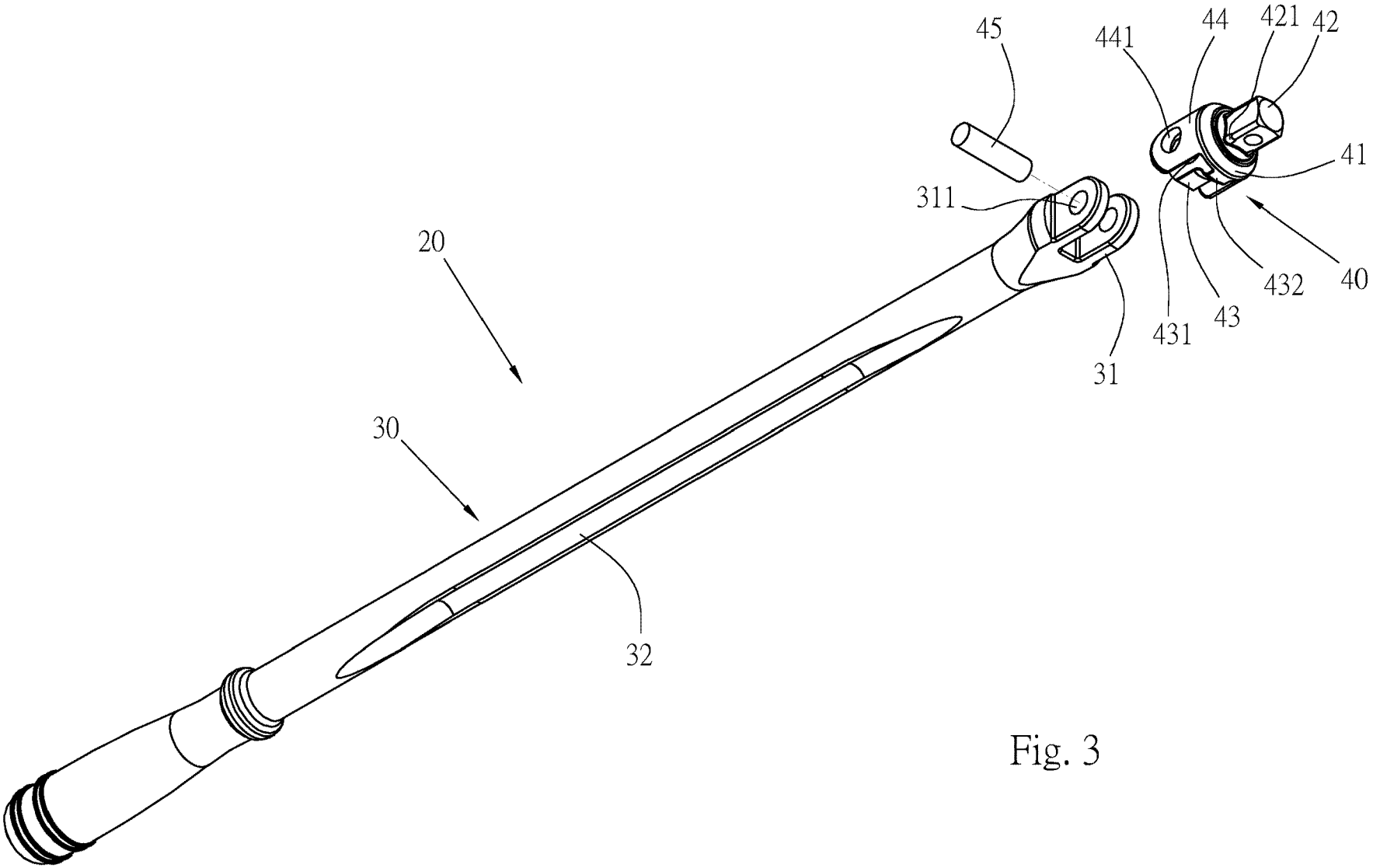
FIG. 3 is an exploded perspective view of FIG. 2.

Please refer to FIGS. 2 to 3, which are a hand tool 20 provided by one preferred embodiment of the invention, including: a main body 30 and a working head 40;

a front end of the main body 30 is formed with two spaced apart and parallel ears 31, the two ears 31 are provided with coaxial connecting holes 311 therethrough; in this embodiment, the main body 30 is integrally formed with a shaft 32 at rear ends of the two ears 31, can also be formed with an assembling portion for assembling with a head of another tool.

Figure 4:
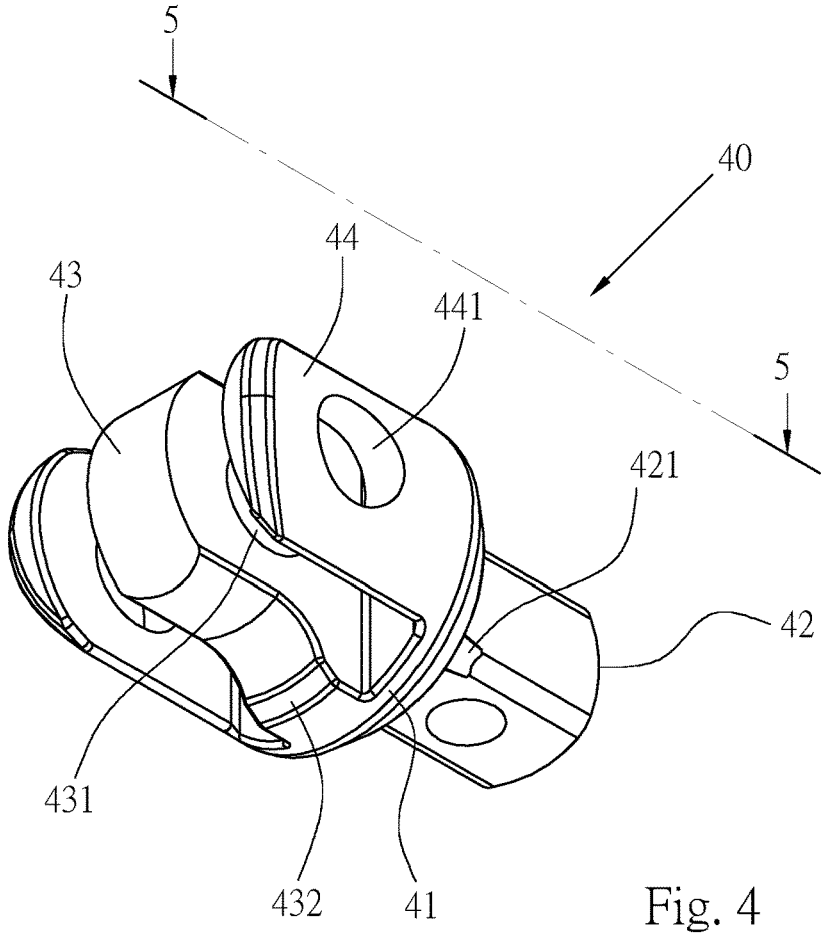
FIG. 4 is a perspective view of a working head of one preferred embodiment of the invention.
Figure 5:
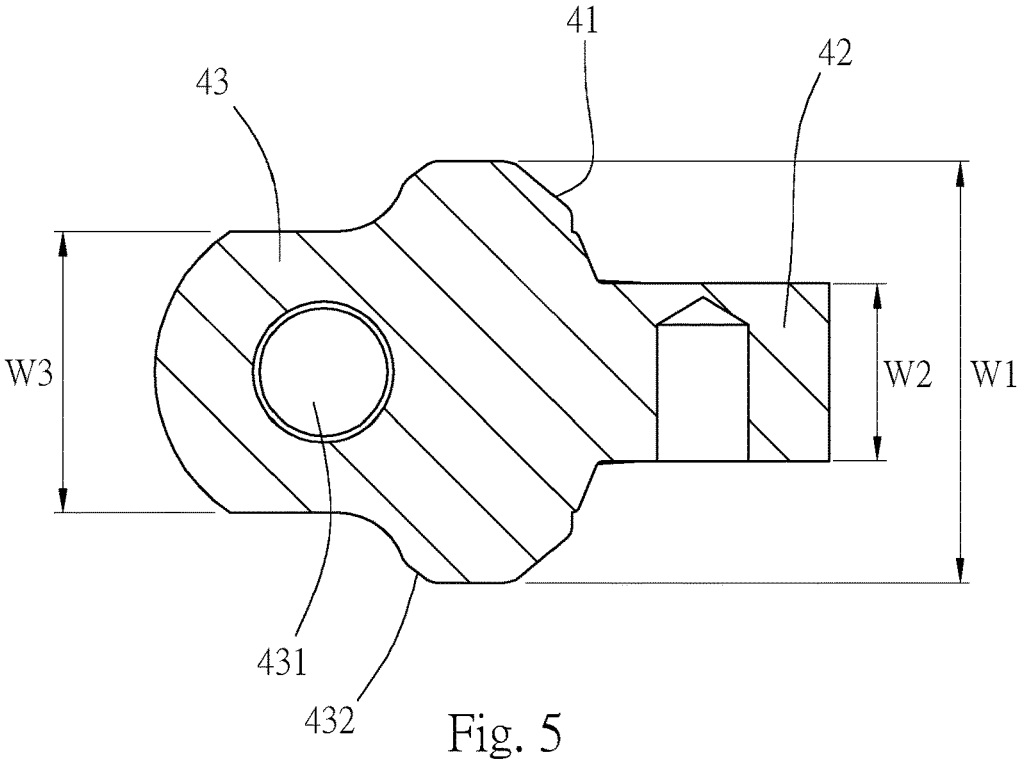
FIG. 5 is a cross-sectional view taken along section line 5-5 of FIG. 4.

Please refer to FIGS. 4 and 5, the working head 40 has a body 41 being cylindrical; a column 42 connected to a bottom of the body 41, in this embodiment, the column 42 is composed of a square head, shape and size thereof can be changed according to requirements; thickened portions 421 are provided at junctions between intersection angles of the column 42 and the body 41 to strengthen a structural strength at a connecting position between the column 42 and the body 41; and a pivotal block 43 disposing at a center position of a top end of the body 41, an outer diameter of the pivotal block 43 is smaller than an outer diameter of the body 41, a center of the pivotal block 43 is provided with a through hole 431 therethrough, two reinforcement blocks 432 are disposed at connecting positions of the pivotal block 43 and the body 41 and along a front edge and a rear edge of the pivotal block 43, and the two reinforcement blocks 432 are connected to an end surface of the body 41. Two flaps 44 are parallelly disposed on the top side of the body 41 and by two sides of the pivotal block 43 respectively, the two flaps 44 are respectively provided with a perforation 441 therethrough, and the two perforations 441 and the through hole 431 of the pivotal block 43 are arranged coaxially.

Figure 6:
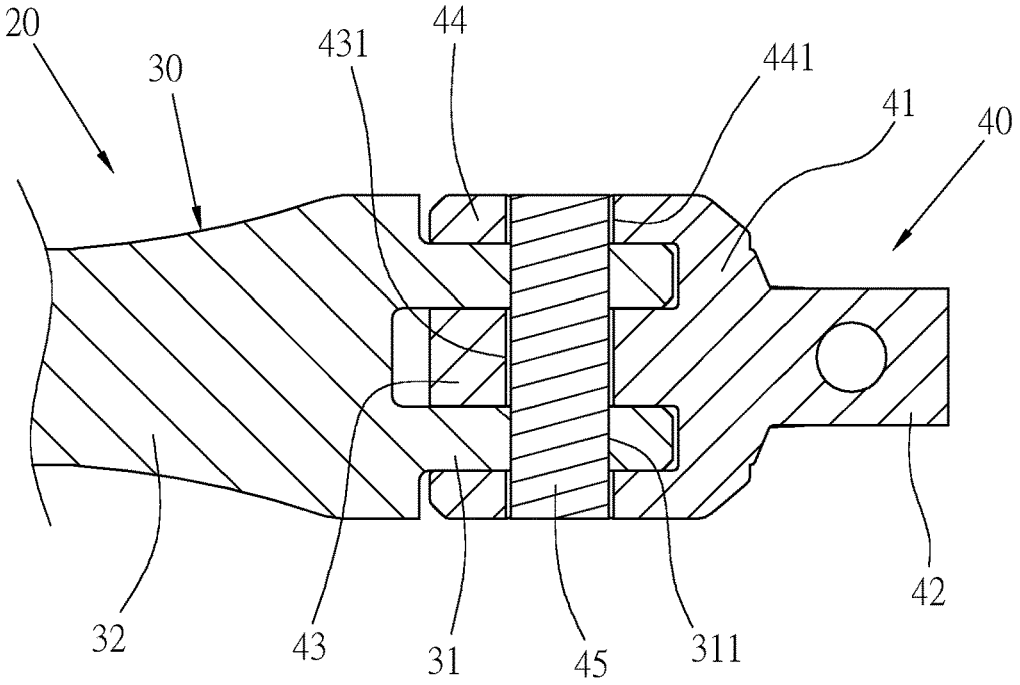
FIG. 6 is a partial cross-sectional view of the hand tool of one preferred embodiment.

Please refer to FIGS. 2 and 4, the connecting holes 311 of the two ears 31 overlap with the through hole 431 of the pivotal block 43 and the perforations 441 of the two flaps 44, and a pin 45 is inserted therein. As shown in FIG. 6, the working head 40 can be pivotally disposed on the main body 30, and the two ears 31 of the main body 30 are located in gaps between the two flaps 44 and the pivotal block 43.

Please refer to FIG. 5, an outer diameter of the body 41 is W1, an outer diameter of the column 42 is W2, and a central position of the pivotal block 43 is a position with a largest outer diameter of the pivotal block 43, and the outer diameter is W3. In this embodiment, the outer diameter W1 of the body 41 is larger than the outer diameter W3 of the pivotal block 43 and the outer diameter W2 of the column 42.

Figure 7:
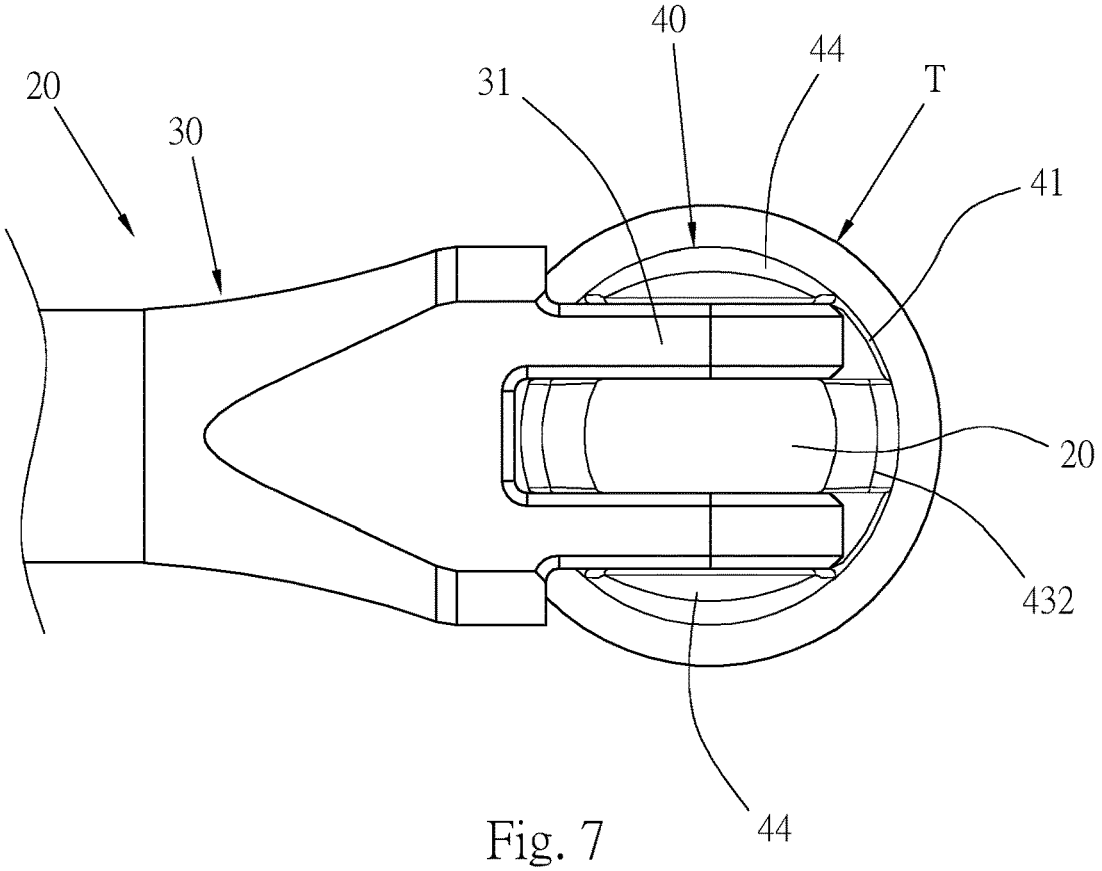
FIG. 7 is a schematic diagram of operation of one preferred embodiment.

Please refer to FIG. 7, in actual operation, the working head 40 of the hand tool 20 is sleeved on a workpiece T (such as a socket), and an angle between the main body 30 and the working head 40 is adjusted. After adjusting the operating angle, a rotational acting force is applied to a position of the shaft 32, the shaft 32 transmits the force to the two ears 31, and then to the pivotal block 43 of the working head 40. During rotation of the body 41 and the column 42 through the pivotal block 43, outer sides of the two ears 31 of the main body 30 are covered by the two flaps 44 at two sides of the working head 40 and disposed by two sides of the pivotal block 43. Because the pivotal block 43 is disposed between the two ears 31, when a force is transmitted from the shaft 32 to the ears 31 of the main body 30, the two ears 31 are supported by the two flaps 44 and the pivotal block 43 to prevent from causing excessive positional changes to the two ears 31 during rotation; thereby reducing deformation generated when the two ears 31 drive the pivotal block 43 to rotate, reducing a shearing force generated due to positional changes between the two ears 31 and the pivotal block 43 during rotation, and enhancing the operating strength and service life. In addition, it is worth mentioning that because the body 41 is located between the pivotal block 43 and the column 42, and the outer diameter W1 of the body 41 is relatively larger, which is capable of forming a relatively larger force-bearing area, so that the pivotal block 43 and the column 42 are not easily damaged due to excessive force being borne. At the same time, the thickened portions 421 at the junction of the column 42 and the body 41 are also capable of forming a relatively larger force-bearing area and generating a relatively larger force-bearing strength at a connecting position of the column 42 and the body 41, which are capable of increasing a torsion that can be borne by the column 42. The reinforcement blocks 432 formed at a connecting position of the pivotal block 43 and the body 41 are also capable of strengthening the strength between the pivotal block 43 and the body 41, so that the junction of the pivotal block 43 and the body 41 is not prone to breakage and damage.

Figure 8:
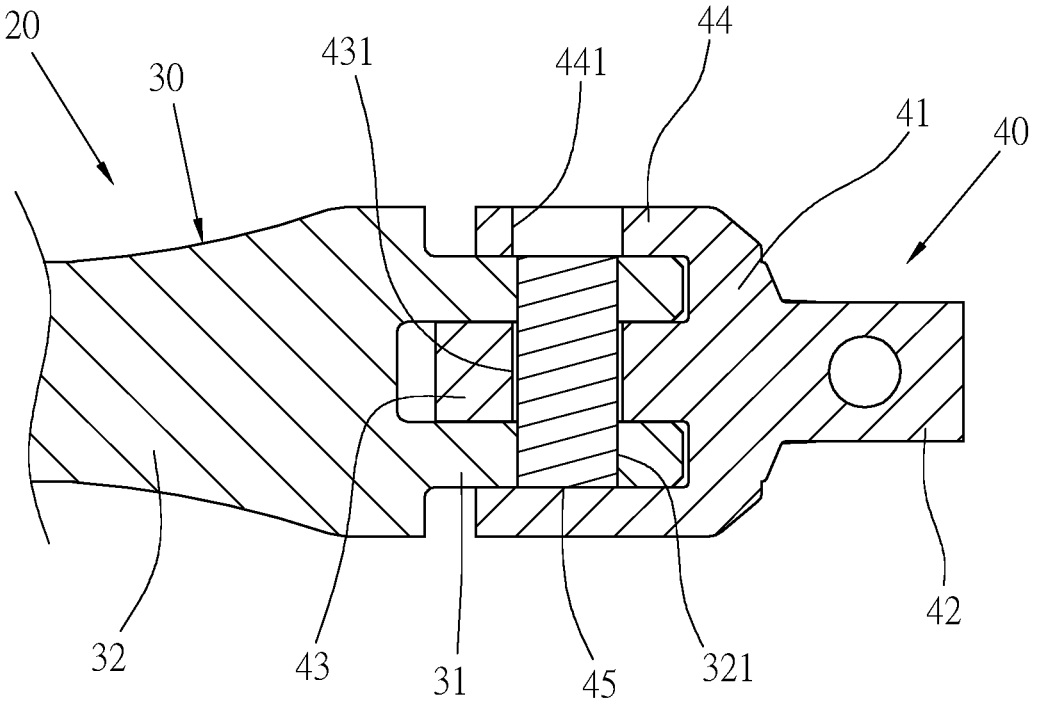
FIG. 8 is a partial cross-sectional view of the hand tool of a second preferred embodiment.

Please refer to FIG. 8 for the hand tool 20 of a second preferred embodiment provided by the invention. The main structure of the hand tool 20 is the same as that of the first preferred embodiment, and the same components are marked with the same reference numerals, which will not be repeated, wherein:

the two flaps 44 of the working head 40 cover the outer sides of the two ears 31, one of the flaps 44 is provided with the perforation 441 therethrough, and the other flap 44 is not provided with the perforation 441, the pin 45 is only inserted through the perforation 441 of the flap 44, the pin 45 is only pivotally disposed in the connecting holes 311 of the two ears 31 of the main body 30 and the through hole 431 of the pivotal block 43, but is not pivotally disposed in the perforation 441 of the flap 44, and the two flaps 44 are disposed on the outer sides of the two ears 31 of the main body 30 in a manner of merely covering and not pivotally connecting. The two flaps 44 are capable of providing a support effect for the two ears 31.

In the hand tool provided by the invention, the two flaps of the working head are provided on the outer sides of the ears of the main body, which are capable of enhancing the force-bearing strength of the two ears of the main body and the two ears are not prone to deformation. Compared with the drawback of being easily deformed and damaged during the process of applying a force due to absence of strengthening structure on the outer sides of the conventional ears of the main body, the flaps provided by the two sides of the pivotal block and the pivotal block of the working head of the invention are capable of strengthening the two ears of the main body and restricting the positions of the two ears of the main body, and preventing the two ears of the main body from deforming excessively in the process of applying a force; thereby enhancing the force-bearing strength, enhancing the service life of the ears of the main body and the torsion of the hand tool.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. A hand tool with an operating head comprising:

a main body having two ears, the two ears being disposed in parallel and spaced apart; and a working head having a body; a column connected to one side of the body; and a pivotal block extending outward from another side of the body, the body being provided with two flaps by two sides of the pivotal block, the two flaps being parallel to the pivotal block, a gap being provided between each of the two flaps and the pivotal block, and the two ears of the main body being pivotally disposed in the gaps between the two flaps and the pivotal block respectively;

wherein each ear of the two ears is located directly between and adjacent to the pivotal block and a corresponding flap of the two flaps;

wherein the two ears, the pivotal block and the two flaps are stacked together and present a five-layer staggered structure defined by a first flap of the two flaps, a first ear of the two ears, the pivotal block, a second ear of the two ears, and a second flap of the two flaps located directly adjacent to one another, respectively, and pivotally connected together;

wherein an outer diameter of the body is greater than an outer diameter of the pivotal block; and wherein reinforcement blocks are provided at junctions of the pivotal block and the body, an outer diameter formed by the reinforcement blocks is greater than that of the pivotal block.

2. The hand tool as claimed in claim 1, wherein the column of the working head is a polygonal column body, and a thickened portion is disposed at a junction between at least one intersection angle of the column and the body.

3. The hand tool as claimed in claim 1, wherein the two ears of the main body are respectively provided with coaxial connecting holes therethrough; the pivotal block is provided with a through hole therethrough, the two flaps are respectively provided with a perforation therethrough, the through hole and the perforations are arranged coaxially; and a pin is pivotally disposed between the connecting holes, the through hole and the perforations.

4. The hand tool as claimed in claim 1, wherein the two ears of the main body are respectively provided with coaxial connecting holes therethrough; the pivotal block is provided with a through hole therethrough, and a pin is pivotally disposed in the overlapping connecting holes and through hole.

5. The hand tool as claimed in claim 4, wherein at least one of the flaps is provided with a perforation for the pin to insert to reach inside the connecting holes of the two ears and the through hole of the pivotal block.

6. The hand tool as claimed in claim 1, wherein an outer diameter of the column of the working head is smaller than an outer diameter of the body.

7. The hand tool as claimed in claim 1, wherein the body is cylindrical.

8. The hand tool as claimed in claim 1, wherein the main body is integrally formed with a shaft at rear ends of the two ears.

* * * * *